US009469114B2

(12) United States Patent
Miyakoshi et al.

(10) Patent No.: US 9,469,114 B2
(45) Date of Patent: Oct. 18, 2016

(54) LIQUID EJECTION APPARATUS

(71) Applicant: CANON KABUSHIKI KAISHA, Tokyo (JP)

(72) Inventors: Arihito Miyakoshi, Tokyo (JP); Masahiko Kubota, Tokyo (JP); Yusuke Imahashi, Kawasaki (JP); Nobuhito Yamaguchi, Inagi (JP); Hiroshi Arimizu, Kawasaki (JP); Yoshinori Itoh, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/718,599

(22) Filed: May 21, 2015

(65) Prior Publication Data

US 2015/0352846 A1 Dec. 10, 2015

(30) Foreign Application Priority Data

Jun. 4, 2014 (JP) ..... 2014-116013

(51) Int. Cl.
*B41J 2/17* (2006.01)
*B41J 11/06* (2006.01)
*B41J 2/185* (2006.01)

(52) U.S. Cl.
CPC ..... *B41J 2/1714* (2013.01); *B41J 11/06* (2013.01); *B41J 2002/1853* (2013.01)

(58) Field of Classification Search
CPC .. B41J 2/1714; B41J 2/20; B41J 2002/1742; B41J 2/16508; B41J 2/185; B41J 11/06; B41J 2002/1853
USPC ..... 347/34
See application file for complete search history.

(56) References Cited

U.S. PATENT DOCUMENTS 4,825,229 A * 4/1989 Matsumoto ..... B41J 2/04 347/21
6,299,293 B1 10/2001 Imanaka et al.
6,340,225 B1 * 1/2002 Szlucha ..... B41J 29/377 101/424.1
6,435,655 B1 8/2002 Yoshihira et al.
6,543,892 B2 4/2003 Kubota et al.
6,789,863 B2 9/2004 Nojima et al.

(Continued)

FOREIGN PATENT DOCUMENTS

CN 102390175 A 3/2012
JP 2006-297801 A 2/2006

(Continued)

OTHER PUBLICATIONS

Chinese Office Action dated Jul. 6, 2016 issued in corresponding Chinese Application No. 201510281949.8.

*Primary Examiner* — Manish S Shah
*Assistant Examiner* — Yaovi M Ameh
(74) *Attorney, Agent, or Firm* — Fitzpatrick, Cella, Harper & Scinto

(57) ABSTRACT

A liquid ejection apparatus is provided which serves to simplify a configuration for collection of mist and to suppress the adverse effect, on landing accuracy for a liquid, of an electrostatic force for connection of mist. The ink jet printing apparatus has a blowout mechanism configured to blow out a gas through a blowout port toward a print medium. Furthermore, the ink jet printing apparatus has an electrode disposed on a platen that supports the print medium and configured to attract mist to the print medium when the electrode is supplied with power.

17 Claims, 13 Drawing Sheets

(56) References Cited

U.S. PATENT DOCUMENTS

| | | | | |
|---|---|---|---|---|
| 7,699,431 | B2 | 4/2010 | Nakazawa et al. | |
| 7,794,035 | B2 | 9/2010 | Imahashi et al. | |
| 2002/0158937 | A1* | 10/2002 | Pietrzyk | B41J 2/04 347/21 |
| 2005/0128275 | A1* | 6/2005 | Uji | B41J 11/007 347/104 |
| 2008/0253797 | A1 | 10/2008 | Sakagami | |
| 2012/0007916 | A1 | 1/2012 | Kumagai | |
| 2015/0085015 | A1 | 3/2015 | Miyakoshi et al. | |

FOREIGN PATENT DOCUMENTS

| | | | |
|---|---|---|---|
| JP | 2007-062116 | A | 3/2007 |
| JP | 2009-101663 | A | 5/2009 |
| JP | 2010-253811 | A | 11/2010 |
| JP | 2011-016283 | A | 1/2011 |

* cited by examiner

LIQUID EJECTION APPARATUS

BACKGROUND OF THE INVENTION

1. Field of the Invention

The present invention relates to a liquid ejection apparatus that ejects a liquid onto a medium, and in particular, to a liquid ejection apparatus with a mechanism that collects mist.

2. Description of the Related Art

In an ink jet printing apparatus, a print head ejects ink for printing. At this time, fine droplets referred to as ink mist generate as a result of ejection of ink droplets forming an image. After ejected from the print head, the ink mist, due to the light weight thereof, floats inside the printing apparatus without landing on a print medium. Furthermore, the ink mist is likely to be affected by surrounding air currents. Thus, the ink mist may fly around inside the ink jet printing apparatus and adhere to various places. In particular, when a large amount of ink mist adheres to a surface of the print head, droplets of the ink mist may merge together into large ink droplets. Then, the merged ink droplets may affect ejected ink droplets around ejection ports, degrading the quality of the image.

Japanese Patent Laid-Open No. 2006-297801 discloses an ink jet printing apparatus provided with an electrode plate that allows a print medium to generate charge in order to allow the print medium to attract the ink mist.

However, the ink jet printing apparatus disclosed in Japanese Patent Laid-Open No. 2006-297801 is configured to allow the print medium to attract the ink mist simply by applying power to electrodes to collect the ink mist, and thus the surface of the print medium needs to be set to a high potential. Thus, not only the ink mist but also main droplets for printing may land on the print medium at incorrect positions by effect of static electricity. This may degrade the quality of the print image.

SUMMARY OF THE INVENTION

Thus, in view of the above-described circumstances, an object of the present invention is to provide a liquid ejection apparatus that suppresses the adverse effect, on landing accuracy, of an electrostatic force for collection of mist.

According to the present invention, a liquid ejection apparatus comprising: a support member configured to be able to support a liquid ejection head that ejects a liquid toward a print medium through ejection ports; a blowout mechanism configured to blow out a gas through a blowout port toward the print medium; and an electrode disposed on a platen that supports the print medium and configured to attract mist to the print medium when the electrode is supplied with power.

According to the present invention, a liquid ejection apparatus comprising: an ejection port through which liquid is ejected; a platen formed at position opposite to the ejection port and configured to support print medium; a blowout port through which gas is blown out toward print medium; and an electrode disposed on the platen and configured to attract mist, that is generated in association with ejection of main droplet through the ejection port, to print medium by supplying with power.

According to the present invention, mist carried to the vicinity of the print medium by blow-out is attracted to the electrodes, thus enabling a reduction in the voltage applied to the electrodes. Therefore, this enables prevention of a decrease in the accuracy of landing of the liquid used for printing, which decrease is caused by an electrostatic force, allowing high quality of a print image to be maintained. Furthermore, the amount of power used to collect mist can be kept small, allowing mist to be efficiently collected.

Further features of the present invention will become apparent from the following description of exemplary embodiments (with reference to the attached drawings).

DESCRIPTION OF THE EMBODIMENTS

Ink jet printing apparatuses (liquid ejection apparatuses) according to embodiments of the present invention will be described.

First Embodiment

An ink jet printing apparatus according to a first embodiment of the present invention will be described.

Figure 1:
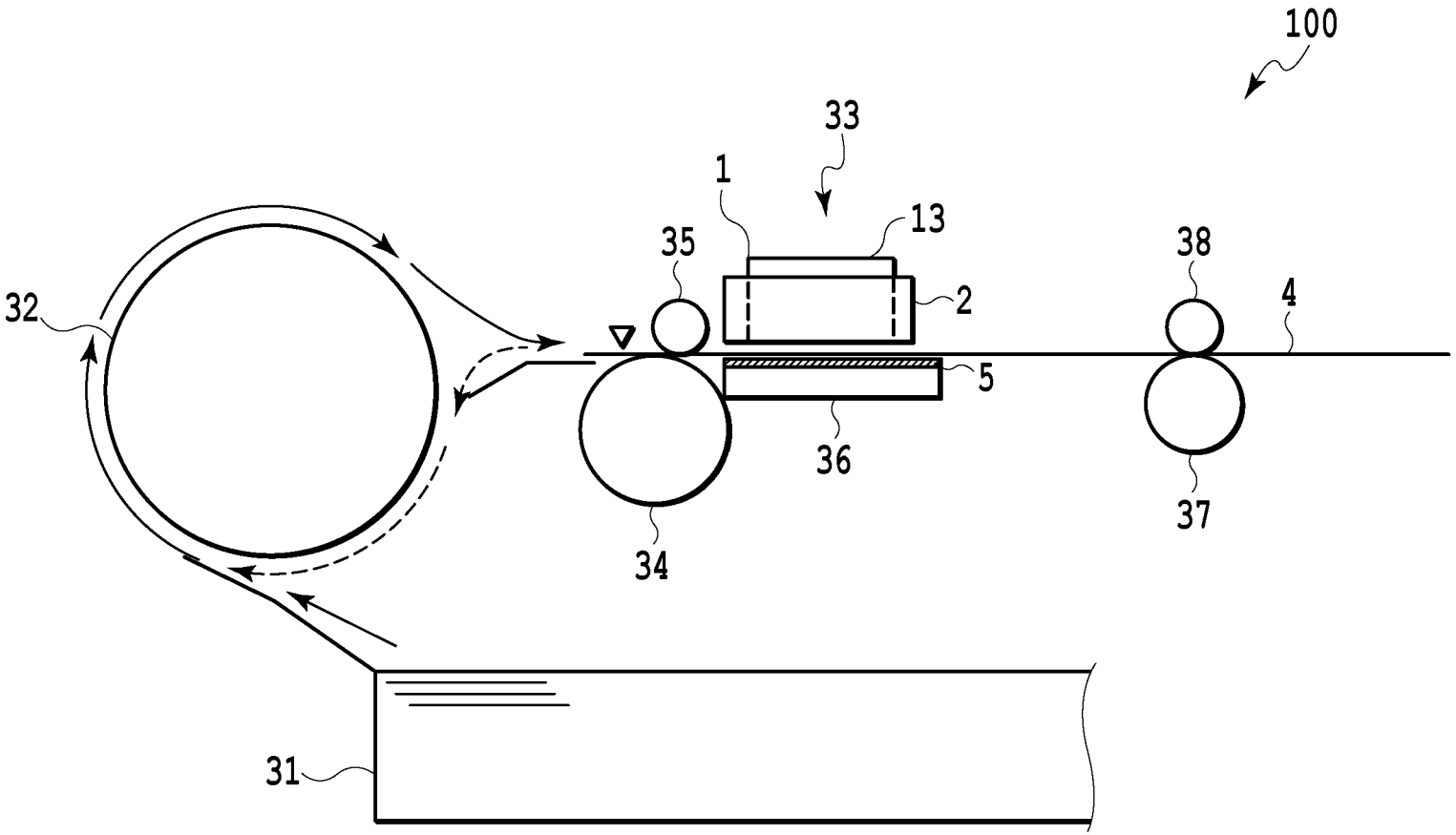
FIG. 1 is a schematic cross-sectional view of an ink jet printing apparatus according to a first embodiment of the present invention.

FIG. 1 shows a schematic cross-sectional view of an ink jet printing apparatus 100. FIG. 1 is a schematic side view of the ink jet printing apparatus 100 as seen from the side of the ink jet printing apparatus 100.

The inkjet printing apparatus 100 includes a sheet feeding cassette 31 and a U-turn conveying unit 32. Print media 4 that have not been printed are housed and stacked in the sheet feeding cassette 31. The U-turn conveying unit 32 is disposed on a downstream side of the print media in the sheet feeding cassette 31 in a conveying direction. The U-turn conveying unit 32 also has the function of a double-side inversion unit. The conveying direction of the print medium is hereinafter simply referred to as the conveying direction. Furthermore, an upstream direction and a downstream direction in the conveying direction of the print medium are hereinafter simply referred to as the upstream side and the downstream side, respectively.

A printing section 33 that prints the print medium is disposed on the downstream side of the U-turn conveying unit 32. The printing section 33 includes a print head (liquid ejection head) 1 that ejects a liquid such as ink. The print head 1 is mounted on a carriage (support member) 13 that can support the print head 1. Furthermore, a conveying roller 34 and a pinch roller 35 are disposed on the upstream side of the print head 1 in the printing section 33. A platen 36 is disposed at a position corresponding to the print head 1 in the printing section 33. The platen 36 supports the print medium conveyed to the position corresponding to the print head 1 during printing. A sheet discharging roller 37 and a pinch roller 38 are disposed on the downstream side of the printing section 33. The sheet discharging roller 37 and the pinch roller 35 discharges the print medium 4 printed by the print head 1 to a sheet discharging position.

In the present embodiment, ink is fed from an ink tank not shown in the drawings to the print head 1, where the ink is stored. A plurality of ejection ports is arranged in lines in a predetermined direction to form a plurality of ejection port arrays. The ejection port arrays formed in the print head 1 are formed to be arranged in the conveying direction of the print medium 4. Ink channels not shown in the drawings are formed in the print head 1 so as to feed the stored ink to the respective ejection ports. The ink fed from the ink tank not shown in the drawings and temporarily stored in the print head 1 can be ejected from the print head 1.

In the present embodiment, heat generating resistor elements (electrothermal convertors) are provided in the ink channels formed in the print head 1. The heat generating resistor elements are energized through wiring to generate thermal energy in the heat generating resistor elements. Thus, the ink in the ink channels is heated to cause film boiling, leading to bubbling. The resultant bubbling energy causes ink droplets to be ejected though the ejection ports.

The ink jet printing apparatus 100 of the first embodiment is a serial scan printing apparatus in which the print head 1 performs scans in a main scanning direction. In the ink jet printing apparatus 100, a carriage moves to enable the print head 1 to move. The ink jet printing apparatus 100 performs a printing operation of allowing the print head 1 to eject the ink toward a print area on the print medium while moving the print head 1 in the main scanning direction 6*a* and a conveying operation of conveying the print medium in a sub-scanning direction 6*c* over a distance corresponding to a print width in the printing operation. An image is sequentially printed on the print medium by alternately repeating the printing operation and the conveying operation.

The print head 1 in the present embodiment uses a scheme in which the heat generating resistor elements cause film boiling and thus bubbling to allow ink droplets to be ejected. However, the present invention is not limited to this. A print head in which a piezoelectric element is deformed to eject a liquid inside the print head may be applied to the printing apparatus, or any other form of print head may be applied to the printing apparatus of the present invention. Furthermore, the ink tank may be of a type mounted in the print head or a type built in the printing apparatus.

Now, components of the ink jet printing apparatus 100 in the present embodiment which are configured to collect ink mist 8 will be described.

The ink jet printing apparatus 100 has a blowout mechanism 2 that blows out a gas to carry ink mist 8 in a direction toward a print medium 4. In the present embodiment, air is illustrated as a gas blown out through a blowout port 3 in the blowout mechanism 2. However, the present invention is not limited to this. A gas different from air may be used as a gas blown out through the blowout port 3. The blowout port 3 in the blowout mechanism 2 is disposed opposite the print medium 4. Furthermore, the blowout mechanism 2 is configured such that, when the print head 1 performs a scan, the blowout mechanism 2 can similarly perform a scan. Thus, the blowout mechanism 2 is configured such that, when the print head 1 performs a scan to move relative to the print medium 4, the blowout mechanism 2 moves relative to the print medium. In the present embodiment, the print head 1 and the blowout mechanism 2 are configured to move along the main scanning direction.

On the platen 36, an electrode 5 is disposed cover the entire position over which the print medium 4 passes. In the present embodiment, in order to collect ink mist resulting from ejection of ink from the print head 1, which reciprocates, the electrode 5 is disposed to cover the entire range of reciprocation of the print head 1. In other words, in the present embodiment, the electrode 5 is disposed to cover the entire range of reciprocation of the print head 1 so as to allow attraction of all of the ink mist present within the range of movement of the print head 1.

Figure 2A:
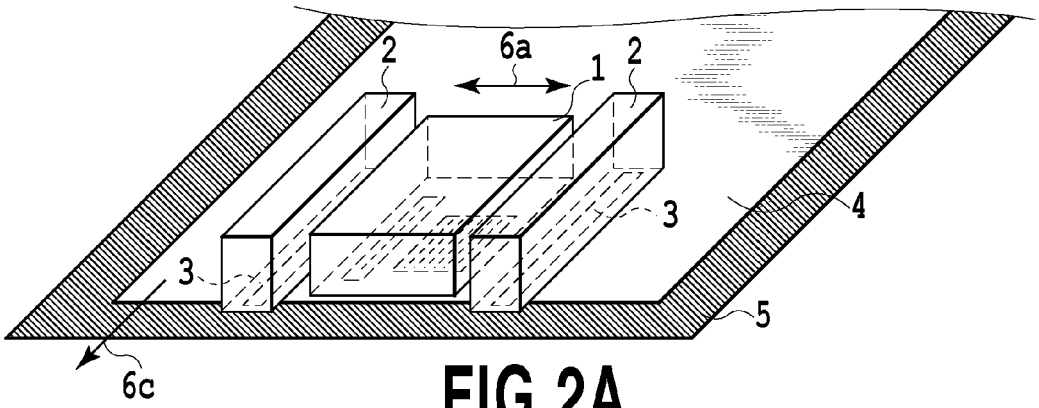
FIG. 2A is a perspective view of the periphery of a print head and blowout mechanisms in the ink jet printing apparatus in FIG. 1.
Figure 2B:
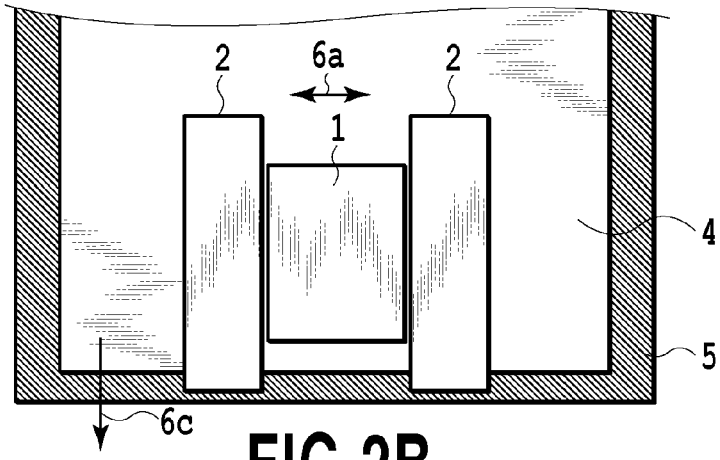
FIG. 2B is a plan view of the periphery of the print head and the blowout mechanisms in the ink jet printing apparatus in FIG. 1.

FIG. 2A shows a perspective view of the print head 1, the blowout mechanism 2, and the electrode 5 in the ink jet printing apparatus 100 according to the first embodiment of the present invention. Furthermore, FIG. 2B is a plan view of the print head 1, the blowout mechanism 2, and the electrode 5 as seen in a direction perpendicular to the print medium 4. Additionally, FIG. 2C shows a cross-sectional view of the print head 1, the blowout mechanism 2, and the electrode 5.

In the present embodiment, during printing, the print head 1 and the blowout mechanism 2 move along the main scanning direction. At this time, the print head 1 and the blowout mechanism 2 move relative to the print medium 4, and thus, between the print head 1 and the print medium 4, air currents occur along the scanning direction 6*a* of the print head 1 and the blowout mechanism 2.

The velocity of the air currents along the print head scanning direction 6*a* decreases with increasing distance from the print head 1 and the blowout mechanism 2. Thus, the ink mist 8 positioned around ejection ports 20 is swept by air currents at relatively high speeds and moves from the position around the ejection ports 20 to the blowout port 3. The ink mist swept from the periphery of the ejection ports in the print head 1 to the periphery of the blowout port 3 is swept in a direction approaching the print medium 4 by blowout through the blowout port 3 positioned rearward in a moving direction of the print head 1.

Figure 2C:
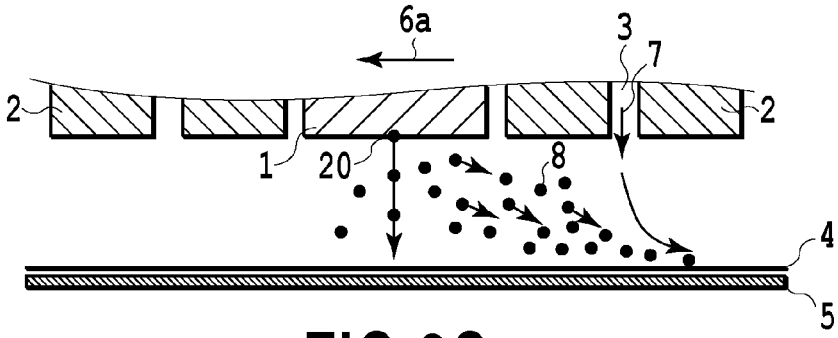
FIG. 2C is a cross-sectional view of the periphery of ejection ports in the print head and the periphery of a blowout port in the blowout mechanism in FIG. 2A.

In the present embodiment, as shown in FIG. 2C, the ink mist 8 is carried to the vicinity of a surface of the print medium 4 by the blowout of gas through the blowout port 3 positioned rearward of the print head 1 in the moving direction of the print head 1. The movement of the print head 1 causes the ink mist 8 resulting from ejection of the ink through the ejection ports 20 to flow rearward in the moving direction of the print head 1. Thus, much of the ink mist 8 is present at a position rearward of the position of the ejection ports 20 in the moving direction. In the present embodiment, the ink mist 8 is carried toward the surface of the print medium 4 by the blowout of the gas through the blowout port 3 positioned rearward in the moving direction of the print head 1. Consequently, since the blowout through the blowout port 3 is targeted at the position where much of the ink mist 8 is present, much of the ink mist 8 can be carried to the surface of the print medium 4. Therefore, the ink mist 8 can be efficiently collected.

In the present embodiment, the ink mist 8 is carried to the surface of the print medium 4 by the blowout through the blowout port 3 positioned rearward of the print head 1 in the moving direction of the print head 1. However, the present invention is not limited to this. The blowout port 3 may be disposed at any other position as long as the ink mist 8 can be carried toward the surface of the print medium 4. For example, a gas may be blown out through the blowout port 3 positioned forward of the print head 1 in the moving direction of the print head 1 to carry the ink mist 8 to the surface of the print medium 4.

In the present embodiment, two blowout mechanisms 2 are disposed in the ink jet printing apparatus 100 as shown in FIGS. 2A to 2C. The two blowout mechanisms 2 are disposed at a forward position and at a rearward position, respectively, in the moving direction of the print head 1 so as to sandwich the print head 1 between the blowout mechanisms 2. Thus, in both forward movement and rearward movement of the reciprocation of the print head 1, the gas may be blown out through the blowout port 3 at a position rearward of the print head 1 in the moving direction of the print head 1. Thus, in both forward movement and rearward movement of the reciprocation of the print head 1, the ink mist 8 can be efficiently collected.

In the present embodiment, the blowout mechanism 2 is disposed on each of the upstream and downstream sides with respect to the print head 1 in the conveying direction of the print medium 4. However, the present invention is not limited to this. Given that the ink jet printing apparatus 100 is a one-way ink jet printing apparatus that performs printing only in one direction in the reciprocation of the print head 1, the blowout mechanisms 2 may be disposed such that the blowout ports 3 are positioned rearward of the print head 1 during printing. The blowout ports 3 may be placed rearward in the moving direction of the print head 1 during printing to enable the ink mist 8 to be carried from the position rearward of the print head 1 toward the print medium 4.

Furthermore, the electrode 5 is disposed on the platen 36. The electrode 5 is disposed so as to be positioned under the print medium 4 when the print medium 4 is placed on the platen 36.

Now, blowout conditions suitable for the present embodiment will be described. When the ink mist 8 is collected, first, the gas is blown out through the blowout ports 3 in the blowout mechanisms 2. With the blowout of the gas through the blowout ports 3, the ink mist 8 present between the print head 1 and the print medium 4 is carried by the gas toward the surface of the print medium 4. Furthermore, the gas is blown out through the blowout ports 3, and a voltage is applied to the electrode 5. The voltage applied to the electrode 5 enables an increase in the potential of the surface of the print medium 4 disposed on the electrode 5. Thus, the ink mist 8 with negative charge is attracted to the surface of the print medium 4.

As described above, the blowout of the gas through the blowout ports 3 causes the ink mist 8 present between the print head 1 and the print medium 4 to be carried in a direction toward the print medium. The application of the voltage to the electrode 5 allows the ink mist 8 to be attracted onto the print medium 4. Therefore, no component for suctioning the ink mist 8 is needed to collect the ink mist 8, allowing a configuration for collection of the ink mist 8 to be simplified. Furthermore, the ink mist 8 is swept by the blowout gas through the blowout ports 3, enabling a reduction in the voltage applied to the electrode 5 in order to attract the ink mist 8. The ink mist 8 can be collected with a relatively low voltage, allowing the ink mist 8 to be efficiently collected.

Furthermore, since, with the ink mist 8 pushed toward the print medium 4 by the blowout through the blowout ports 3, the voltage is applied to the electrode 5 to attract the ink mist 8 to the print medium 4, the ink mist 8 can be promptly collected. Therefore, the time needed to collect the ink mist 8 can be reduced.

Additionally, since the voltage applied to the electrode 5 can be reduced, the ink ejected through the ejection ports 20 can be restrained from being affected by the electrostatic force of the electrode 5. Therefore, this enables suppression of a possible decrease in the landing accuracy of ink droplets associated with the print head 1, allowing the quality of print image to be kept high.

In the present embodiment, a gas 7 is blown out through the blowout ports 3 such that the blowout takes place substantially perpendicularly to the print medium 4 so as to allow the gas 7 to reliably reach the print medium 4. In the present embodiment, the scan speed of the print head 1 is 0.6 m/s, the distance between the print head 1 and the print medium 4 is 1 mm, the width of the blowout port 3 is 500 μm, and the blowout speed of the gas 7 is 2.5 m/s.

Since the ink mist 8 is collected as described above, the ink mist 8 flowing in the ink jet printing apparatus 100 can be reliably collected, allowing the inside of the ink jet printing apparatus 100 to be kept clean. Thus, a situation can be suppressed in which the ink mist 8 continues to adhere to the ink jet printing apparatus 100 and accumulates, thus adhering to and staining the print medium. This allows the quality of the print image to be restrained from being degraded.

In the present embodiment, the collection of the ink mist 8 is executed while printing is performed by ejection of the ink from the print head 1. Thus, the print medium 4 to which the ink mist 8 is attracted is the print medium being printed. The ink mist 8 collected by the collection mechanism for the ink mist in the present embodiment is ink mist with a relatively small particle size. In the present embodiment, since the relatively low voltage is applied to the electrode to attract the ink mist 8 to the print medium 4, the particle size of the ink mist attracted to the print medium when the voltage is applied to the electrode 5 is relatively small. Thus, even though the ink mist 8 is attracted to the print medium 4 being printed, little adverse effect is exerted on the print image. As described above, when the ink mist 8 is collected, the voltage applied to the electrode 5 is set to a relatively small value to allow the ink mist 8 to be collected without affecting the print image.

In the present embodiment, the collection of the ink mist 8 is parallel with the printing operation. However, the present invention is not limited to this. The collection of the ink mist 8 may be executed at a timing different from the timing for the printing operation. Furthermore, the print medium to which the ink mist 8 is attracted may be a print medium different from the print medium that is printed. Other kind of print medium may be used for collection of the ink mist 8. Additionally, in such a case, given that the adverse effect of the ink mist on the print medium need not be taken into account, the ink jet printing apparatus may be configured so as to allow ink mist with a relatively large particle size to be attracted by setting a high voltage to be applied to the electrode 5.

Now, the polarity of the electrode 5 in the present embodiment will be described. As is known, although the polarity of the charge of the ink mist 8 varies with the type of the ink, the ink mist 8 often has negative charge. In the present embodiment, the electrode 5 has positive polarity so as to attract the ink mist 8 to the surface of the print medium 4 by means of the electrostatic force generated by the electrode 5.

Figure 3A:
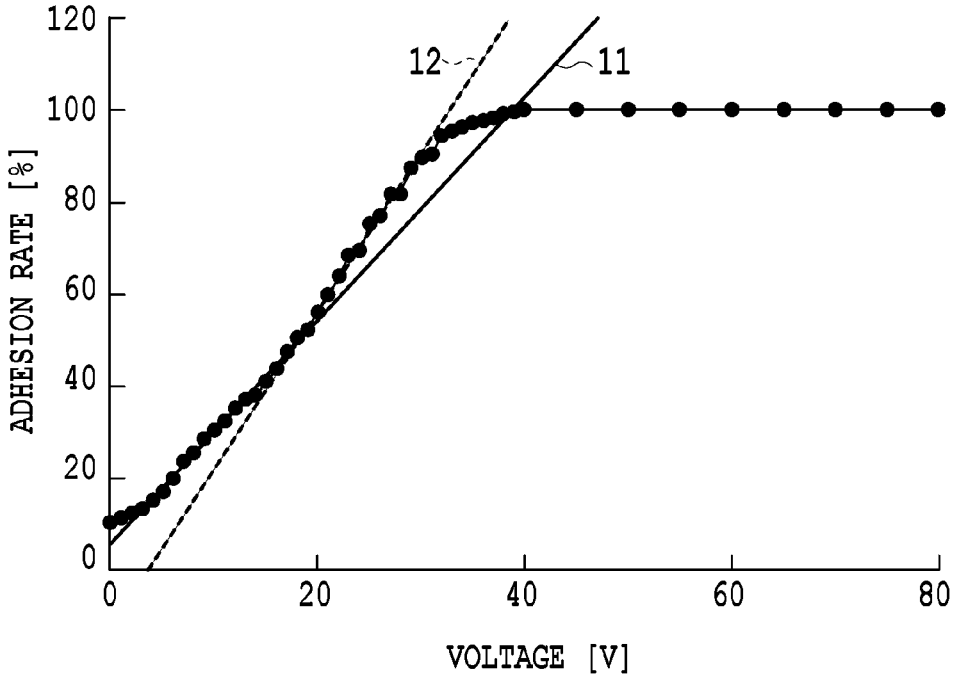
FIG. 3A is a graph depicting the relation between the magnitude of a voltage applied to an electrode within the range of 0 to 80 V and the adhesion rate of ink mist attracted to a print medium.
Figure 3B:
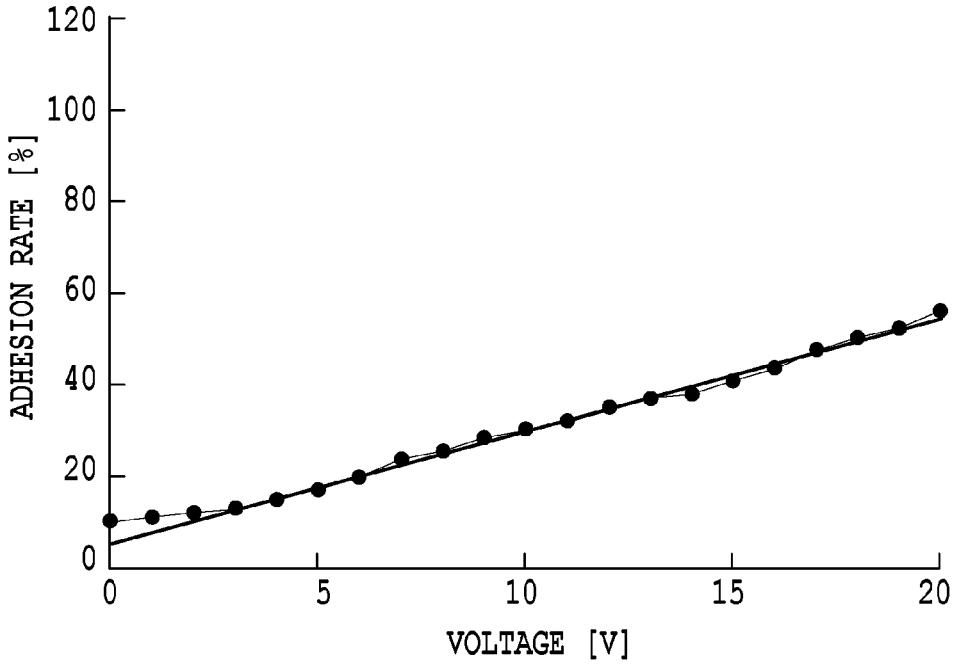
FIG. 3B is a graph depicting the relation between the magnitude of the voltage within the range of 0 to 20 V and the adhesion rate of the ink mist.

Now, the magnitude of the voltage applied to the electrode 5 will be described. The present inventors derived the relation between the voltage applied to the electrode 5 and the rate of adhesion of the ink mist 8 to the print medium 4, by using simulation. FIG. 3A shows the relation the voltage applied to the electrode 5 and the rate of adhesion of the ink mist 8 to the print medium 4 when the voltage applied to the electrode 5 is within the range of 0 to 80 V. FIG. 3B shows the relation the voltage applied to the electrode 5 and the rate of adhesion of the ink mist 8 to the print medium 4 when the voltage applied to the electrode 5 is within the range of 0 to 20 V. The rate of adhesion of the ink mist 8 to the print medium 4 refers to the rate of a portion of the ink mist present between the print medium 4 and the both the print head 1 and the blowout mechanism 2 that can be attracted to the print medium 4 when the voltage is applied to the electrode 5.

FIG. 3B shows, in addition to the distribution of the adhesion rate of the ink mist, a first-order regression curve for an applied voltage within the range of 4 to 20 V. The slope of the distribution of the ink mist adhesion rate at a voltage of 0 to 4 V is compared with the slope of the distribution of the ink mist adhesion rate at a voltage of 4 V or higher. Then, the comparison indicates that the ink mist adhesion rate at a voltage of 4 V or higher exhibits a larger slope. In other words, when the magnitude of the voltage applied to the electrode 5 is increased, the degree of a corresponding increase in ink mist adhesion rate is higher when the voltage is 4 V or higher than when the voltage is between 0 V and 4 V.

As described above, the results of the regression analysis indicate that the rate of adhesion to the print medium 4 changes significantly when the voltage is 4 V or higher. Thus, a change in voltage resulting from an increase in voltage when the voltage is 4 V or higher contributes relatively significantly to improving the adhesion rate of the ink mist 8. The ink mist 8, having a small particle size, is significantly affected by air currents resulting from conveyance of the print medium 4, and moves in the conveying direction 9 of the print medium 4. In contrast, the ink mist 8 has very low charge, and thus, only a weak electrostatic force is exerted on the ink mist 8 when the applied voltage is lower than 4 V. Hence, the air currents cause most of the ink mist 8 to leave the area on which the electrostatic force acts. Therefore, the voltage applied to the electrode 5 is preferably 4 V or higher.

Furthermore, a dashed straight line depicted in FIG. 3A indicates the results for the 1st-order regression curve for the adhesion rate of the ink mist 8 obtained when the applied voltage is 20 to 30 V. The results of the regression analysis indicate that the graph has a steep slope when the applied voltage is 20 V or higher. In other words, an increase in the magnitude of the voltage applied to the electrode 5 increases the degree of a corresponding increase in the adhesion rate of the ink mist 8. Therefore, as shown in the figure, the rate of adhesion to the print medium 4 changes significantly in the area where the applied voltage is 20 V or higher. An increased voltage applied to the electrode 5 increases the force that attracts the ink mist 8 to the print medium 4. Thus, even though subjected to a force in a direction in which the ink mist 8 is swept by air currents resulting from conveyance of the print medium 4, the ink mist 8 can be electrostatically attached to the print medium 4 against the force. FIG. 3A indicates that, when the voltage applied to the electrode 5 is 20 V or higher, the amount of ink mist 8 electrostatically attached to the print medium against the force exerted by the air currents relatively significantly increases. Thus, the voltage applied to the electrode 5 is preferably 20 V or higher.

Furthermore, as shown in FIG. 3A, the rate of adhesion to the print medium 4 is 100% when the applied voltage is 40 V or higher. Although the amount of charge of the ink mist 8 varies slightly with the type of the ink, an applied voltage of 40 V or higher allows approximately 100% of the ink mist 8 to be attracted to the print medium 4. Thus, the voltage applied to the electrode 5 is preferably 40 V or higher.

As described above, the gas 7 is blown out to carry the ink mist 8 to the vicinity of the print medium 4 and the carried ink mist 8 is then attached to the print medium using the electrode 5. Then, the ink mist 8 can be attached to the print medium 4 even when a low voltage is applied to the electrode 5. Thus, when the ink mist 8 is attracted to the print medium 4, the ink mist 8 is carried to the vicinity of the print medium 4 by the blowout. This enables the voltage applied to the electrode 5 to be kept lower than in the case where the ink mist is attracted simply by applying a voltage to the electrode. That is, the ink mist can be collected without the need to excessively increase the surface potential of the print medium 4. Thus, the amount of power used to collect the ink mist 8 can be kept small, enabling the ink mist 8 to be efficiently collected and allowing costs needed to collect the ink mist 8 in the ink jet printing apparatus 100 to be kept low. Furthermore, a possible decrease in the landing accuracy of ink droplets can be suppressed, allowing the quality of the print image to be kept high. Additionally, the ink mist can be collected using the simple configuration in the ink jet printing apparatus 100. Therefore, the ink jet printing apparatus 100 can be miniaturized, and the manufacturing costs of the ink jet printing apparatus 100 can be kept low.

In the present embodiment, the electrode 5 is disposed to cover the entire area over which the print head 1 moves in order to deal with the ink mist from the moving print head 1. However, the present invention is not limited to this. The electrode 5 may be partly disposed within the range of movement of the printhead 1. Alternatively, a plurality of the electrodes 5 may be disposed within the range of movement of the print head 1 with a gap formed between the electrodes 5. Alternatively, for efficient collection of the ink mist, as the print head 1 moves, the electrode 5 may move in conjunction with movement of the print head 1. The ink jet printing apparatus 100 is configured as described above to enable the ink mist to be collected around the print head 1, allowing the ink mist to be more efficiently collected.

Second Embodiment

Now, an ink jet printing apparatus according to a second embodiment will be described. Components of the second embodiment similar to the corresponding components of the first embodiment are denoted by the same reference numerals in the figures and will not be described. Only differences from the first embodiment will be described.

In the first embodiment, the form has been described in which the present invention is applied to the serial scan ink jet printing apparatus performing printing while the print head 1 is moving along the main scanning direction. In contrast, in the second embodiment, the present invention is applied to a full line ink jet printing apparatus that uses a print head extending all over the print medium in the width direction thereof.

In the second embodiment, the print head 1 and the blowout mechanism 2 are disposed opposite the print medium 4 as is the case with the first embodiment. In the present embodiment, no scan is performed by the print head 1. The print medium 4 is moved along the conveying direction relative to the print head 1 and the blowout mechanism 2.

An ejection port array extending all over the print medium in the width direction is disposed in the print head 1 so that the print medium can be entirely printed in the width direction. The ejection port array is formed of a plurality of ejection port groups 50 arranged in array and each formed of a plurality of ejection ports 20 assembled together. In the present embodiment, the plurality of ejection port groups 50 is arranged in a staggered manner to form the ejection port array. Printing is performed by ejecting the ink from the print head 1 while conveying the print medium 4. In the second embodiment, the print head 1 performs no scan, and the print medium 4 moves relative to the print head 1 and the blowout mechanism 2, with the ink ejected onto the print medium 4 for printing.

Figure 4A:
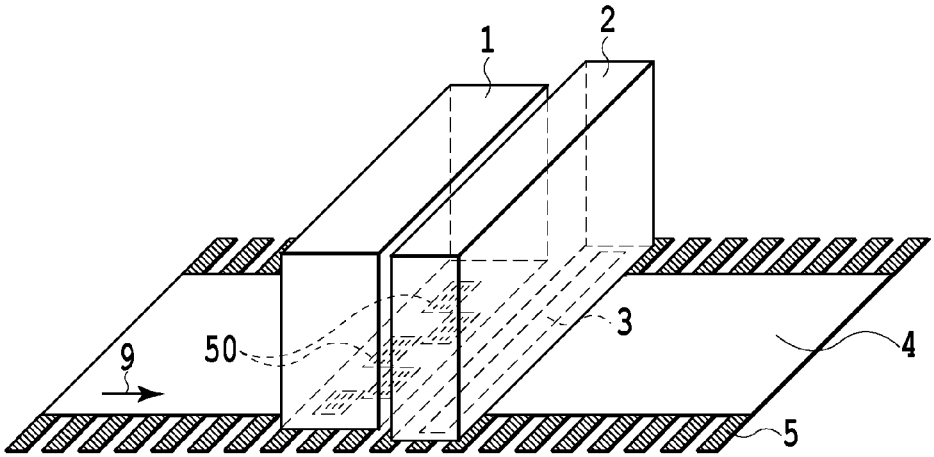
FIG. 4A is a perspective view of the periphery of the print head and the blowout mechanism in an ink jet printing apparatus according to a second embodiment of the present invention.
Figure 4B:
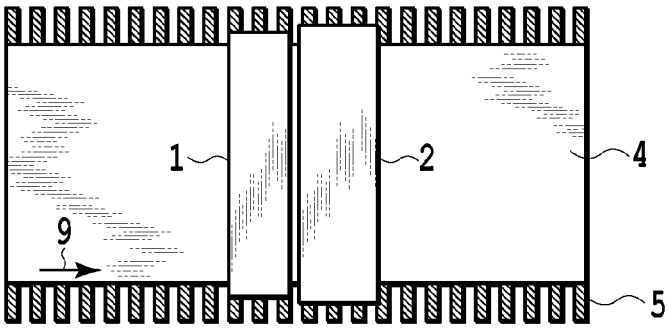
FIG. 4B is a plan view of the periphery of the print head and the blowout mechanism in the ink jet printing apparatus according to the second embodiment of the present invention.
Figure 4C:
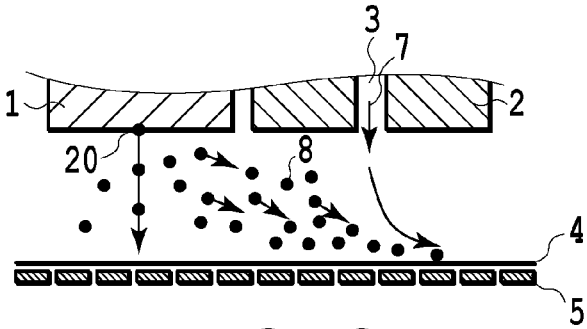
FIG. 4C is a cross-sectional view of the periphery of the ejection ports in the print head and the periphery of the blowout port in the blowout mechanism in FIG. 4A.

FIG. 4A is a perspective view showing the print head 1, the blowout mechanism 2, and the electrode 5 in the ink jet printing apparatus of the second embodiment of the present invention. FIG. 4B is a plan view of the periphery of the print head 1 and the blowout mechanism 2 in the inkjet printing apparatus according in FIG. 4A, seen along the direction perpendicular to print medium. FIG. 4C is a cross-sectional view of the periphery of the ejection ports 20 in the print head 1 and the periphery of the blowout port 3 in the blowout mechanism 2 in the ink jet printing apparatus according in FIG. 4A.

Since the print medium 4 moves relative to the print head 1 and the blowout mechanism 2, air currents along the conveying direction 9 of the print medium 4 occur between the print head 1 and the print medium 4. The ink mist 8 resulting from ejection of ink droplets through the ejection ports is carried by the air currents toward the blowout port 3 along the conveying direction. Thus, the air currents move the ink mist 8 in a direction from the position of the ejection ports in the print head 1 toward the blowout mechanism 2.

In the present embodiment, the print head 1 and the blowout mechanism 2 are disposed in this order from the upstream side in the conveying direction 9 of the print medium 4 as shown in FIG. 4C. Furthermore, an electrode 5 group formed of a plurality of band-like electrodes 5 is disposed on the platen 36 and under the print medium 4.

In the present embodiment, the blowout port 3 in the blowout mechanism 2 is disposed on the downstream side with respect to the print head 1 in the conveying direction of the print medium 4 as depicted in FIG. 4C. That is, the ink mist 8 is carried to the vicinity of the surface of the print medium 4 by blowout of the gas through the blowout port 3 positioned rearward in the direction of movement of the print head 1 relative to the print medium 4. The conveyance of the print medium 4 causes the ink mist 8 resulting from the ejection of the ink through the ejection ports 20 to be swept by the air currents. At this time, the ink mist 8 flows downstream side in the conveying direction of the print medium 4. In other words, the ink mist 8 flows rearward in the direction of movement of the print head 1 relative to the print medium 4. Thus, much of the ink mist 8 is present at a downstream position with respect to the position of the ejection ports 20 in the conveying direction of the print medium 4. In the present embodiment, the ink mist 8 is carried toward the surface of the print medium 4 by the blowout of the gas through the blowout port 3 positioned on the downstream side in the conveying direction of the print medium 4. Consequently, the blowout through the blowout port 3 is targeted at the position where much of the ink mist 8 is present, and much of the ink mist 8 can be carried to the surface of the print medium 4. The ink mist 8 can thus be efficiently collected.

In the present embodiment, the ink mist 8 is carried to the surface of the print medium 4 by the blowout through the blowout port 3 positioned on the downstream side of the print head 1 in the conveying direction of the print medium 4. However, the present invention is not limited to this. The blowout port 3 may be disposed at any other position as long as the ink mist 8 can be carried toward the surface of the print medium 4. For example, the gas may be blown out through the blowout port 3 positioned on the upstream side of the print head 1 in the conveying direction of the print medium 4 to carry the ink mist 8 to the surface of the print medium 4.

In the second embodiment, as shown in FIGS. 4A to 4C, since the plurality of band-like electrodes is disposed, the gap is formed between the electrodes 5. In the second embodiment, during printing, the print head 1 does not scan or move. Thus, positions in the inkjet printing apparatus where the ink mist is generated are limited. The form in which the plurality of band-like electrodes 5 is disposed as shown in FIGS. 4A to 4C may be used as long as it is previously known that the collection of the ink mist can be sufficiently achieved, when printing is performed, even with the form in which the plurality of electrodes 5 is disposed. This disposition of the electrodes 5 allows for a configuration that reduces the area in which the electrodes 5 are arranged. Therefore, when the ink mist is collected, power applied to the electrodes 5 can be kept low. Since the power consumed to collect the ink mist can be kept low, the operating costs of the ink jet printing apparatus can be kept down.

In the present embodiment, the gas 7 is blown out toward the print medium 4 through the blowout mechanism 2 as is the case with the first embodiment. The gas is blown out at such an intensity as allows the gas blown out through the blowout port 3 in the blowout mechanism 2 to reach the print medium 4. Furthermore, a voltage is applied to the electrodes 5 such that the electrodes 5 have a positive polarity. Thus, in the present embodiment, the ink mist 8 can be carried to the vicinity of the print medium 4 by the blowout of the gas 7, and the carried ink mist 8 can be attracted onto the print medium 4 by the application of the voltage to the electrodes 5.

With the collection mechanism for the ink mist 8 configured as described above, the ink mist 8 carried by the blowout of the gas can be collected without being sucked, allowing the configuration for collection of the ink mist 8 to be simplified. Furthermore, since the ink mist is swept by the blowout of the gas, the ink mist 8 can be attracted to the print medium 4 at the relatively low voltage applied to the electrodes 5.

Since the ink mist is swept toward the electrodes by the blowout so as to be attracted to the electrodes, the ink mist need not be sucked and can be efficiently collected by application of low power. Furthermore, the ink mist is not collected simply by the application of the voltage to the electrodes. This enables a reduction in the voltage applied to the electrodes.

Third Embodiment

Now, an ink jet printing apparatus according to a third embodiment will be described. Components of the third embodiment similar to the corresponding components of the second embodiment are denoted by the same reference numerals in the figures and will not be described. Only differences from the second embodiment will be described.

In the first embodiment and the second embodiment, the electrode 5 is also disposed in the upstream area with respect to the conveying direction of the print head 1. In the first embodiment and the second embodiment, a portion of the electrode 5 is disposed in the area where the ink mist 8 is unlikely to be generated, and a voltage is applied to this portion. However, normally, at the upstream position with respect to the print head 1, the ink mist is unlikely to be generated. Thus, the voltage is applied to the electrode 5 at the position thereof where the ink mist is unlikely to be generated, and may thus be wastefully used. Consequently, more voltage than needed may be supplied to the electrode 5, reducing the efficiency of collection of the ink mist 8.

In contrast, in the third embodiment, the area where the electrode 5 is disposed is limited only to positions immediately below the print headland downstream positions with respect to the print head 1. That is, the electrodes 5 are disposed on the platen 36 at positions corresponding to the print head 1 and downstream positions with respect to the positions corresponding to the print head 1 in the conveying direction of the print medium 4. This reduces the amount of power supplied to the electrodes 5. The ink mist 8 can be efficiently collected with reduced power.

Figure 5A:
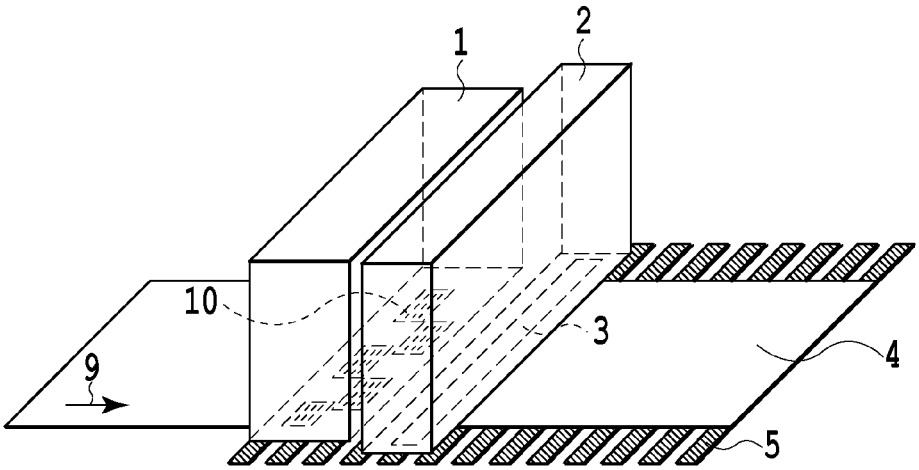
FIG. 5A is a perspective view of the periphery of the print head and the blowout mechanism in an ink jet printing apparatus according to a third embodiment of the present invention.
Figure 5B:
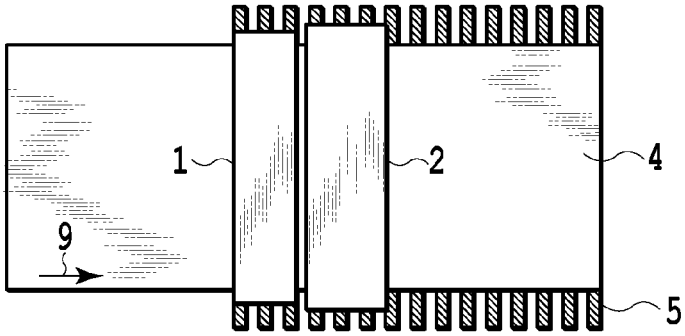
FIG. 5B is a plan view of the periphery of the print head and the blowout mechanism in the ink jet printing apparatus according to the third embodiment of the present invention.
Figure 5C:
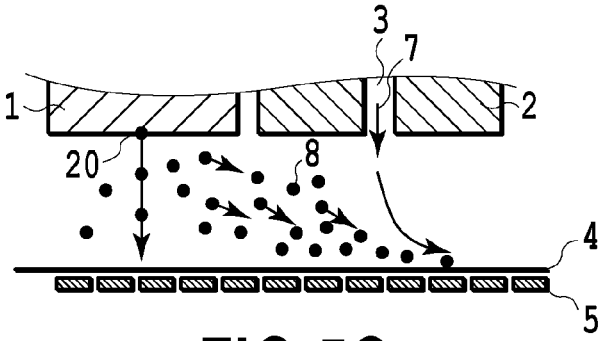
FIG. 5C is a cross-sectional view of the periphery of the ejection ports in the print head and the periphery of the blowout port in the blowout mechanism in FIG. 5A.

FIG. 5A shows a perspective view of the periphery of the print head 1 and the blowout mechanism 2 in the ink jet printing apparatus according to the third embodiment. FIG. 5B shows a plan view of the periphery of the print head 1 and the blowout mechanism 2 in the ink jet printing apparatus according to the third embodiment. FIG. 5C shows a cross-sectional view of the periphery of the ejection ports 20 in the print head 1 and the periphery of the blowout port 3 in the blowout mechanism 2 in the ink jet printing apparatus according to the third embodiment.

When the ink is ejected from the print head 1, most of the ink mist 8 is affected by air currents resulting from conveyance of the print medium 4 and moves in the direction from the position of the ejection ports 20 through which the ink is ejected as described above, toward the blowout mechanism 2. In this regard, the blowout of air through the blowout port 3 in the blowout mechanism 2 causes the ink mist 8 swept toward the blowout port 3 to flow toward the print medium 4.

A portion of the ink mist 8 may move to the upstream side with respect to the position of the ejection ports in the conveying direction 9 of the print medium 4. Such ink mist may be offset by the air currents resulting from the conveyance of the print medium 4 and float at the position corresponding to the ejection ports 20. Such ink mist can be collected by application of a voltage to the electrode 5 disposed at the position corresponding to the print head 1.

As described above, in the present embodiment, the electrodes 5 are disposed at the positions immediately below the print head 1 and at the downstream positions with respect to the print head 1 in the conveying direction of the print medium 4. Thus, power consumption is kept low, allowing the ink mist 8 to be efficiently collected.

Fourth Embodiment

Now, an ink jet printing apparatus according to a fourth embodiment will be described. Components of the fourth embodiment similar to the corresponding components of the first to third embodiments are denoted by the same reference numerals in the figures and will not be described. Only differences from the first to third embodiments will be described.

In the third embodiment, the electrodes 5 are disposed at the positions immediately below the print head 1 and at the downstream positions with respect to the print head 1 in the conveying direction of the print medium. However, when the electrodes 5 are disposed at the positions immediately below the ejection port 20 in the print head 1, ink droplets ejected through the ejection ports 20 for printing are affected by application of a voltage to the electrodes 5. Main droplets ejected through the ejection ports 20 for printing may land at inappropriate positions for ink droplets for printing under an electrostatic force resulting from the application of power to the electrodes 5. This may degrade the quality of the print image.

Thus, in the fourth embodiment, the electrode 5 is not disposed at the positions immediately below the print head 1. The electrodes 5 are disposed only at the downstream positions with respect to the print head 1 in the conveying direction of the print medium. In the fourth embodiment, the electrodes 5 are disposed so as to extend downstream along the conveying direction of the print medium from the position of an upstream end of the blowout mechanism 2 in the conveying direction.

In the present embodiment, the electrode 5 is not disposed at the positions immediately below the print head 1. However, in view of the accuracy of the landing positions of the ink droplets ejected through the ejection ports 20, the electrode 5 may avoid being disposed at positions immediately below the ejection ports 20. Thus, the electrodes 5 may be disposed at the positions immediately below the print head 1 other than the positions where the ejection ports 20 are formed. That is, the electrodes 5 may be disposed on the platen 36 at downstream positions with respect to the position corresponding to the ejection ports 20.

Figure 6A:
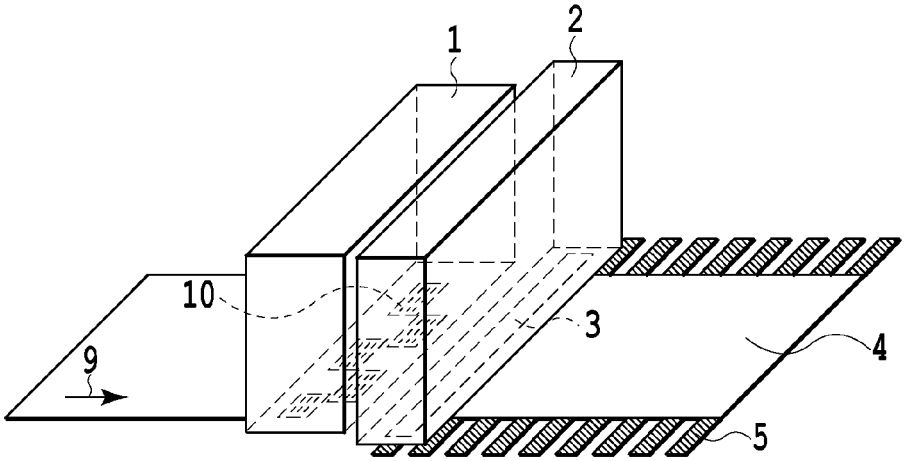
FIG. 6A is a perspective view of the periphery of the print head and the blowout mechanism in an ink jet printing apparatus according to a fourth embodiment of the present invention.
Figure 6B:
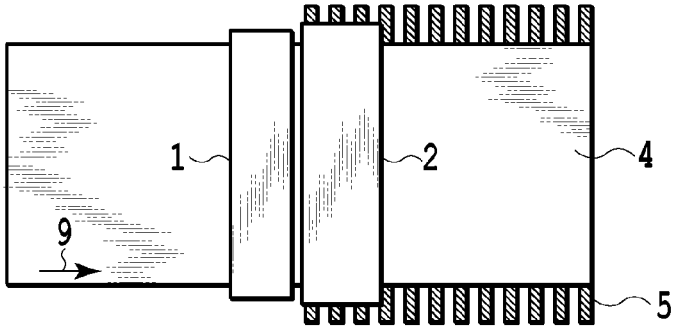
FIG. 6B is a plan view of the periphery of the print head and the blowout mechanism in the ink jet printing apparatus according to the fourth embodiment of the present invention.
Figure 6C:
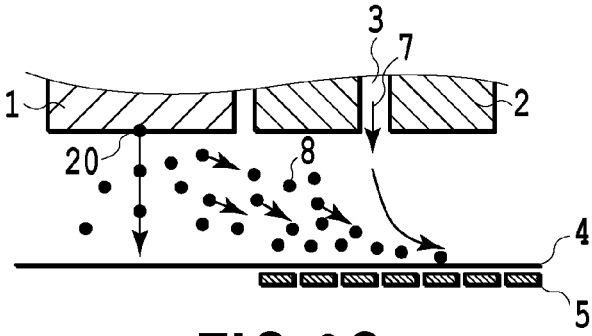
FIG. 6C is a cross-sectional view of the periphery of the ejection ports in the print head and the periphery of the blowout port in the blowout mechanism in FIG. 6A.

FIG. 6A shows a perspective view of the periphery of the print head 1 and the blowout mechanism 2 in the ink jet printing apparatus according to the fourth embodiment. FIG. 6B shows a plan view of the periphery of the print head 1 and the blowout mechanism 2 in the ink jet printing apparatus according to the fourth embodiment. FIG. 6C shows a cross-sectional view of the periphery of the ejection ports 20 in the print head 1 and the periphery of the blowout port 3 in the blowout mechanism 2 in the ink jet printing apparatus according to the fourth embodiment.

As described above, the electrodes 5 are disposed only at the downstream positions with respect to the ejection ports 20 in the conveying direction. Thus, even when power is applied to the electrodes 5, ink droplets ejected through the ejection ports 20 of the print head 1 for printing can be restrained from being attracted to the electrodes 5. Therefore, ink droplets ejected through the ejection ports 20 for printing can be restrained from landing at inappropriate positions. This keeps the quality of the print image high. Furthermore, the area of the electrodes 5 is kept smaller, allowing power applied to the electrodes 5 to be kept low.

Fifth Embodiment

Now, an ink jet printing apparatus according to a fourth embodiment will be described. Components of the fifth embodiment similar to the corresponding components of the first to fourth embodiments are denoted by the same reference numerals in the figures and will not be described. Only differences from the first to fourth embodiments will be described.

In the fourth embodiment, the electrodes 5 are disposed only at the downstream positions with respect to the print head 1 in the conveying direction. In the fourth embodiment, in particular, the electrodes 5 are disposed so as to extend downstream along the conveying direction from the upstream end of the blowout mechanism 2 in the conveying direction of the print medium. In contrast, in the fifth embodiment, the electrodes 5 are disposed so as to extend downstream along the conveying direction from positions immediately below the blowout port 3 in the blowout mechanism 2. In other words, the electrodes 5 are disposed on the platen 36 at the positions corresponding to the blowout port 3 and at the downstream positions with respect to the positions corresponding to the blowout port 3 in the conveying direction.

Figure 7A:
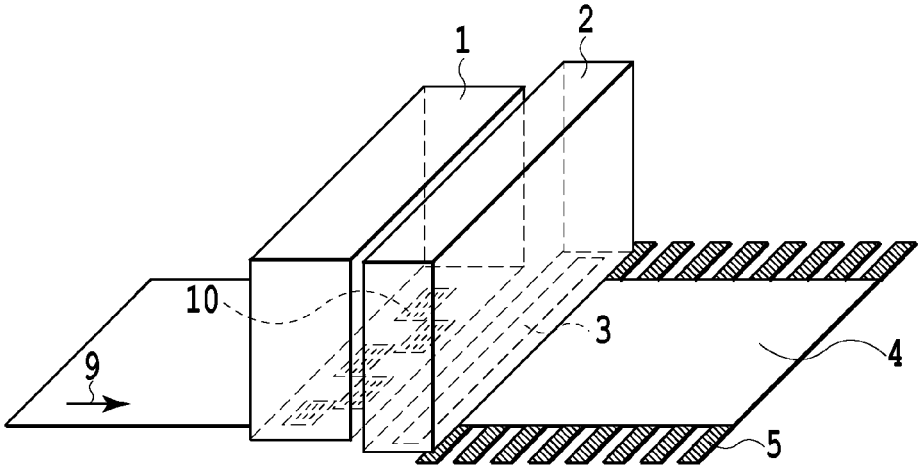
FIG. 7A is a perspective view of the periphery of the print head and the blowout mechanism in an ink jet printing apparatus according to a fifth embodiment of the present invention.
Figure 7B:
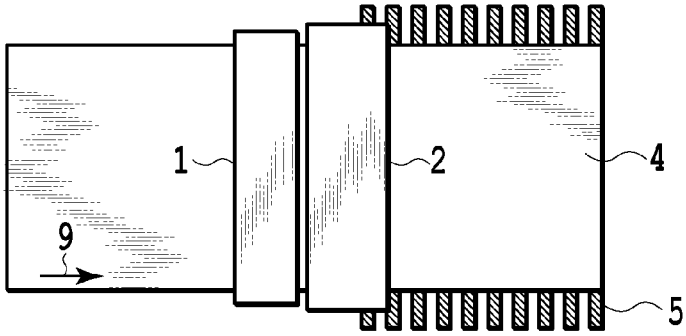
FIG. 7B is a plan view of the periphery of the print head and the blowout mechanism in the ink jet printing apparatus according to the fifth embodiment of the present invention.
Figure 7C:
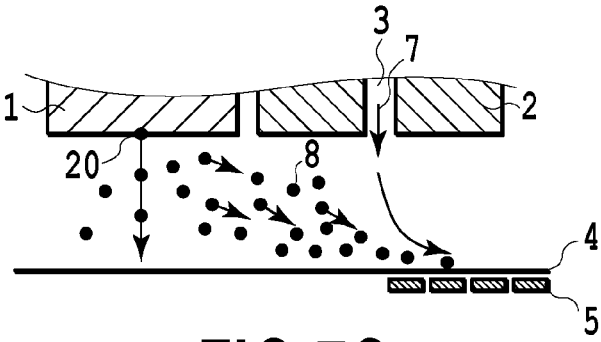
FIG. 7C is a cross-sectional view of the periphery of the ejection ports in the print head and the periphery of the blowout port in the blowout mechanism in FIG. 7A.

FIG. 7A shows a perspective view of the periphery of the print head 1 and the blowout mechanism 2 in the ink jet printing apparatus according to the fifth embodiment. FIG. 7B depicts a plan view of the periphery of the print head 1 and the blowout mechanism 2 in the ink jet printing apparatus according to the fifth embodiment. FIG. 7C shows a cross-sectional view of the periphery of the ejection ports 20 in the print head 1 and the periphery of the blowout port 3 in the blowout mechanism 2 in the ink jet printing apparatus according to the fifth embodiment.

The electrodes 5 are thus disposed at the positions corresponding to the blowout port 3 and at the downstream positions with respect to the positions corresponding to the blowout port 3 in the conveying direction. Thus, ink droplets ejected through the ejection ports in the print head 1 for printing can be more reliably restrained from being attracted to the electrodes 5. Therefore, ink droplets ejected through the ejection ports for printing can be more reliably restrained from landing at inappropriate positions. This keeps the quality of the print image high. Furthermore, the area of the electrodes 5 is kept much smaller, allowing power applied to the electrodes 5 to be kept low.

Sixth Embodiment

Now, an ink jet printing apparatus according to a sixth embodiment will be described. Components of the sixth embodiment similar to the corresponding components of the first to fifth embodiments are denoted by the same reference numerals in the figures and will not be described. Only differences from the first to fifth embodiments will be described.

In the fifth embodiment, the electrodes 5 are disposed so as to extend downstream along the conveying direction from the positions immediately below the blowout port 3 in the blowout mechanism 2. In contrast, in the sixth embodiment, the electrodes 5 are disposed so as to extend downstream in the conveying direction of the print medium from the position of a downstream end of the blowout mechanism 2 in the conveying direction. The electrodes 5 are disposed at downstream positions with respect to a portion of the blowout mechanism 2 opposite to the print medium in the conveying direction of the print medium.

Figure 8A:
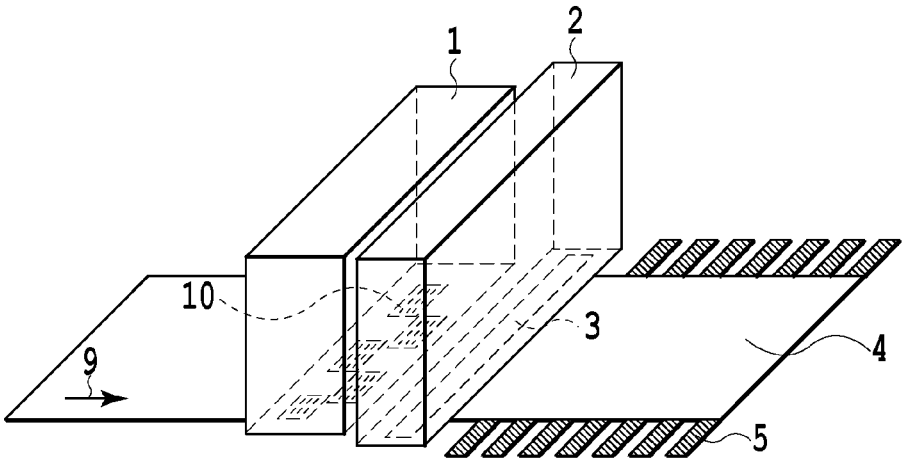
FIG. 8A is a perspective view of the periphery of the print head and the blowout mechanism in an ink jet printing apparatus according to a sixth embodiment of the present invention.
Figure 8B:
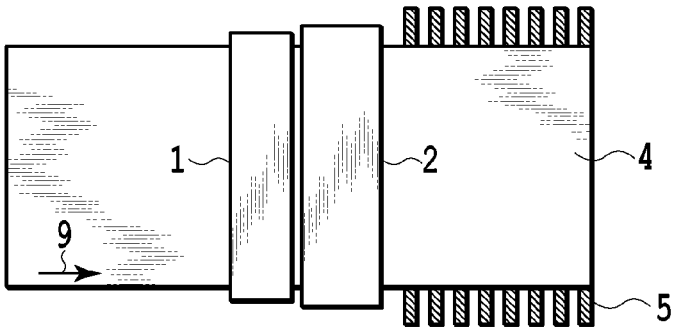
FIG. 8B is a plan view of the periphery of the print head and the blowout mechanism in the ink jet printing apparatus according to the sixth embodiment of the present invention.
Figure 8C:
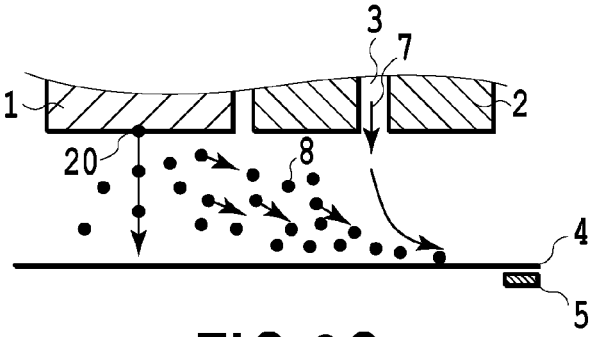
FIG. 8C is a cross-sectional view of the periphery of the ejection ports in the print head and the periphery of the blowout port in the blowout mechanism in FIG. 8A.

FIG. 8A denotes a perspective view of the periphery of the print head 1 and the blowout mechanism 2 in the ink jet printing apparatus according to the sixth embodiment. FIG. 8B denotes a plan view of the periphery of the print head 1 and the blowout mechanism 2 in the ink jet printing apparatus according to the sixth embodiment. FIG. 8C denotes a cross-sectional view of the periphery of the ejection ports 20 in the print head 1 and the periphery of the blowout port 3 in the blowout mechanism 2 in the ink jet printing apparatus according to the sixth embodiment.

In the sixth embodiment, the electrodes 5 are disposed at the downstream positions with respect to the portion of the blowout mechanism 2 opposite to the print medium 4 in the conveying direction of the print medium 4. Thus, ink droplets ejected through the ejection ports in the print head 1 for printing can be more reliably restrained from being attracted to the electrodes 5. Therefore, ink droplets ejected through the ejection ports 20 in the print head 1 for printing can be more reliably restrained from landing at inappropriate positions. This keeps the quality of the print image high.

Seventh Embodiment

Now, an ink jet printing apparatus according to a seventh embodiment will be described. Components of the seventh embodiment similar to the corresponding components of the first to sixth embodiments are denoted by the same reference numerals in the figures and will not be described. Only differences from the first to sixth embodiments will be described.

In the first to sixth embodiments, the configuration has been described which is configured to collect ink mist resulting from ejection of ink droplets from the single print head 1 disposed in the ink jet printing apparatus. In contrast, in the seventh embodiment, a plurality of print heads 1 is supported and disposed. Furthermore, a plurality of blowout mechanisms 2 is disposed in association with the respective plurality of print heads 1 so as to sweep the ink mist 8 generated in the respective print heads 1. A plurality of electrodes 5 is disposed in association with the respective plurality of print heads 1 so as to collect the ink mist 8 resulting from ink ejection from the respective print heads 1.

Figure 9A:
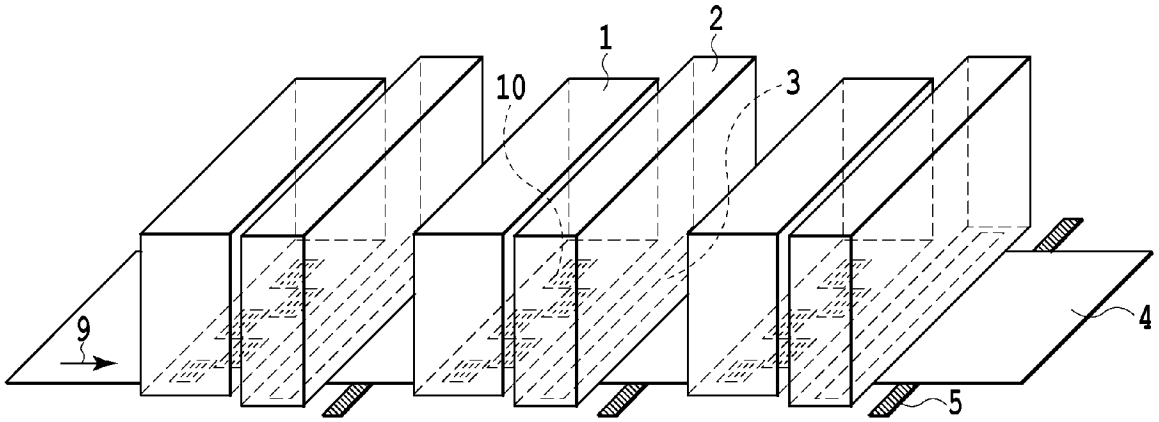
FIG. 9A is a perspective view of the periphery of the print head and the blowout mechanism in an ink jet printing apparatus according to a seventh embodiment of the present invention.
Figure 9B:
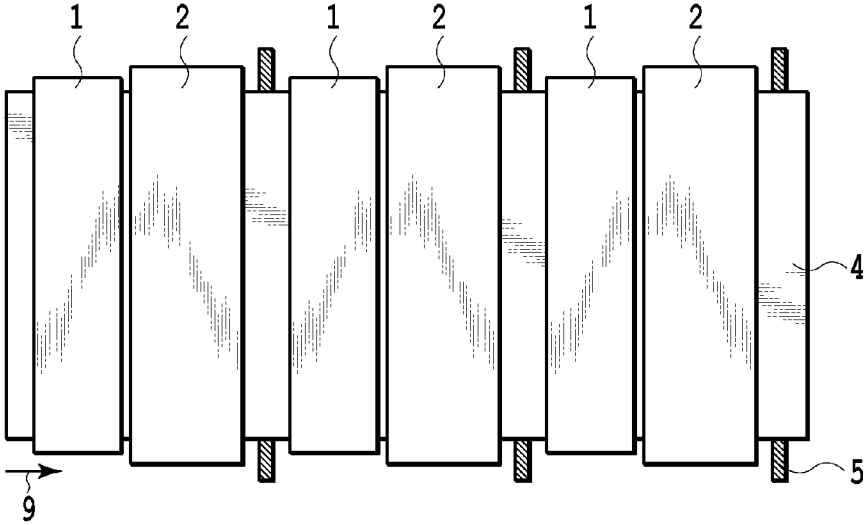
FIG. 9B is a plan view of the periphery of the print head and the blowout mechanism in the ink jet printing apparatus according to the seventh embodiment of the present invention.

FIG. 9A is a perspective view of the periphery of the print head 1 and the blowout mechanism 2 in the ink jet printing apparatus according to the seventh embodiment. FIG. 9B is a plan view of the periphery of the print head 1 and the blowout mechanism 2 in the ink jet printing apparatus according to the seventh embodiment.

The blowout mechanisms 2 and the electrodes 5 are disposed in association with the respective plurality of print heads 1 to enable efficient collection of the ink mist 8 resulting from ejection of ink droplets from the respective print heads 1. Therefore, power consumption can be kept low, allowing the operating costs of the ink jet printing apparatus to be kept down. Furthermore, no configuration for sucking the ink mist 8 needs to be provided. Consequently, the ink jet printing apparatus can be miniaturized, and the manufacturing costs of the ink jet printing apparatus can be kept low.

Eighth Embodiment

Now, an ink jet printing apparatus according to an eighth embodiment will be described. Components of the eighth embodiment similar to the corresponding components of the first to seventh embodiments are denoted by the same reference numerals in the figures and will not be described. Only differences from the first to seventh embodiments will be described.

In the second to seventh embodiments, the electrode 5 is disposed so as to be longer than the print head 1 and the blowout mechanism 2 along the direction in which the ejection port array in the print head 1 is arranged. However, since air currents resulting from conveyance of the print medium occur along the conveying direction 9, a relatively small amount of ink mist is present in areas outside the print head 1 and the blowout mechanism 2 along the direction in which the ejection port array is arranged. Even if power is applied to a portion of each electrode 5 positioned outside the print head 1 and the blowout mechanism 2 along the direction in which the ejection port array is arranged, only a small amount of ink mist is collected at the corresponding position. Therefore, in the areas outside the print head 1 and the blowout mechanism 2 along the direction in which the ejection port array is arranged, the efficiency of collection of the ink mist by the electrode 5 is relatively low.

Thus, the eighth embodiment is configured such that the length of each electrode 5 along the direction in which the ejection port array is arranged is approximately equal to the length of the print head 1 along the direction in which the ejection port array is arranged. In this manner, the length of each electrode 5 along the direction in which the ejection port array is arranged may be equal to or smaller than the length of the print head 1 along the direction in which the ejection port array is arranged so that the electrode 5 is disposed inside an area corresponding to the print head 1 on the platen 36.

Figure 10A:
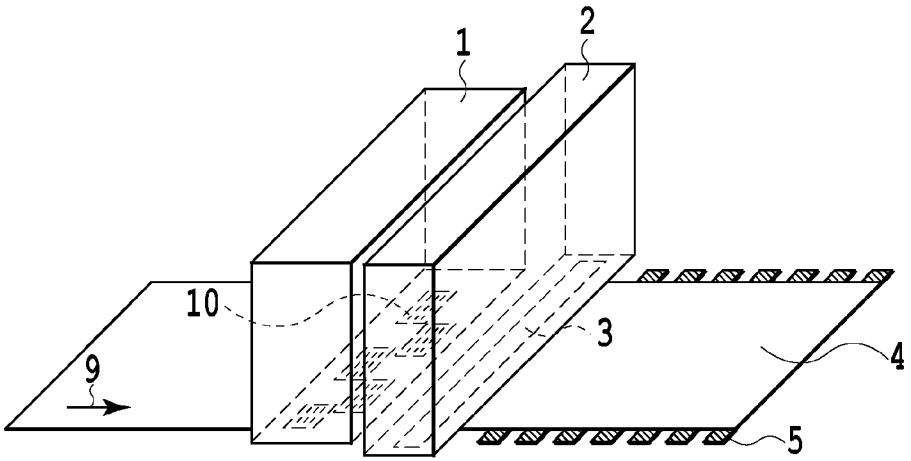
FIG. 10A is a perspective view of the periphery of the print head and the blowout mechanism in an ink jet printing apparatus according to an eighth embodiment of the present invention.
Figure 10B:
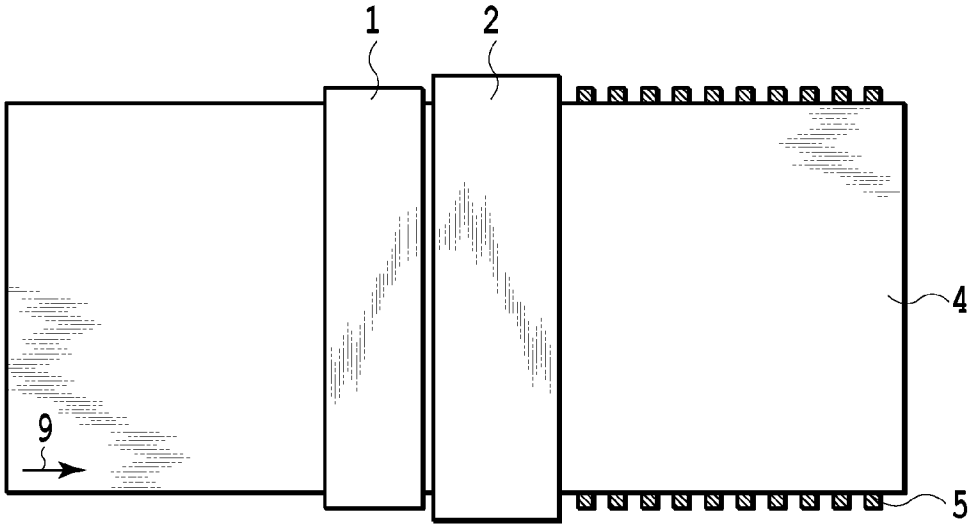
FIG. 10B is a plan view of the periphery of the print head and the blowout mechanism in the ink jet printing apparatus according to the eighth embodiment of the present invention.

FIG. 10A shows a perspective view of the periphery of the print head 1 and the blowout mechanism 2 in the ink jet printing apparatus according to the eighth embodiment. FIG. 10B shows a plan view of the periphery of the print head 1 and the blowout mechanism 2 in the ink jet printing apparatus according to the eighth embodiment.

As described above, the length of each electrode 5 along the direction in which the ejection port array is arranged is equal to or smaller than the length of the print head 1 along the direction in which the ejection port array is arranged so that the electrode 5 is disposed inside the area corresponding to the print head 1 on the platen 36. Consequently, a voltage is applied to the electrode 5 only at the position where much of the ink mist 8 is present, and thus, the area of a portion of the electrode 5 to which power is applied is kept small. Therefore, the power applied to the electrodes 5 can be kept low. Furthermore, at the position where much of the ink mist 8 is present, the ink mist 8 can be collected by the electrodes 5. As a result, the ink mist 8 can be efficiently collected.

Ninth Embodiment

Now, an ink jet printing apparatus according to a ninth embodiment will be described. Components of the ninth embodiment similar to the corresponding components of the first to eighth embodiments are denoted by the same reference numerals in the figures and will not be described. Only differences from the first to eighth embodiments will be described.

The eighth embodiment is configured such that the length of each electrode 5 along the direction in which the ejection port array is arranged is approximately equal to the length of the print head 1 and blowout mechanism 2 along the direction in which the ejection port array is arranged.

However, in the configuration of the eighth embodiment, the length of the electrode 5 along the direction in which the ejection port array is arranged is larger than the length of the print medium along the direction in which the ejection port array is arranged. The electrode 5 protrudes out from the print medium in the direction in which the ejection port array is arranged. Since the electrode 5 protrudes out from the print medium along the direction in which the ejection port array is arranged, the ink mist 8 adheres to the portion of the electrode 5 protruding out from the print medium when power is applied to the electrode 5.

As described above in the eighth embodiment, a relatively small amount of ink mist 8 is present in the area outside the print head 1 and the blowout mechanism 2 in the direction in which the ejection port array is arranged. However, in spite of a small amount, the ink mist 8 may also be present in the area outside the print head 1 and the blowout mechanism 2 in the direction in which the ejection port array is arranged. The ink mist 8 present in the area outside the print head 1 and the blowout mechanism 2 in the direction in which the ejection port array is arranged adheres easily to the electrode 5 in the area thereof not covered with the print medium 4. When the ink jet printing apparatus is continuously used for a long time, the ink mist 8 may accumulate in the portion of the electrode 5 protruding out from the print medium 4 in the direction in which the ejection port array is arranged. When the accumulated ink mist 8 comes into contact with the print medium in the portion of the electrode 5 protruding out from the print medium 4 in the direction in which the ejection port array is arranged, the accumulated ink mist 8 may adhere to the print medium 4 to degrade the quality of the print image.

In contrast, in the present embodiment, the length of the electrode 5 along the direction in which the ejection port array is arranged is approximately equal to the length of the print medium along the direction in which the ejection port array is arranged. In this manner, the length of the electrode 5 along the direction in which the ejection port array is arranged may be equal to or smaller than the length of the print medium along the direction in which the ejection port array is arranged so that, when the print medium is placed on the platen 36, the electrode 5 is covered with the print medium.

Figure 11A:
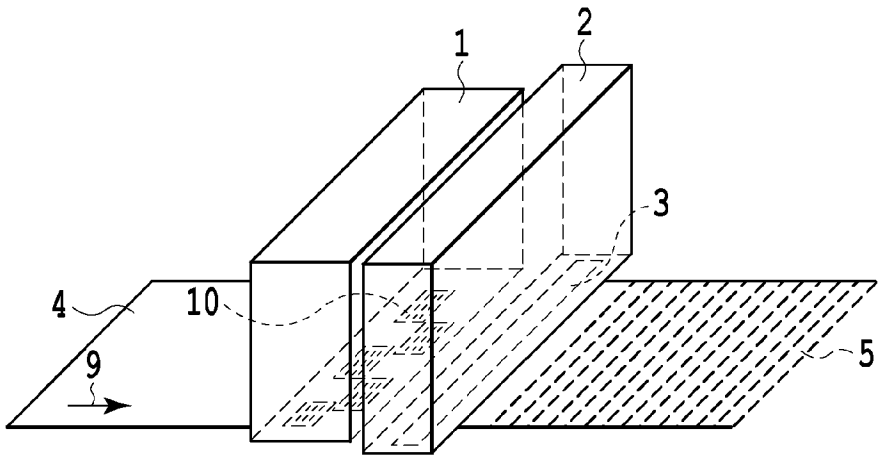
FIG. 11A is a perspective view of the periphery of the print head and the blowout mechanism in an ink jet printing apparatus according to a ninth embodiment of the present invention.
Figure 11B:
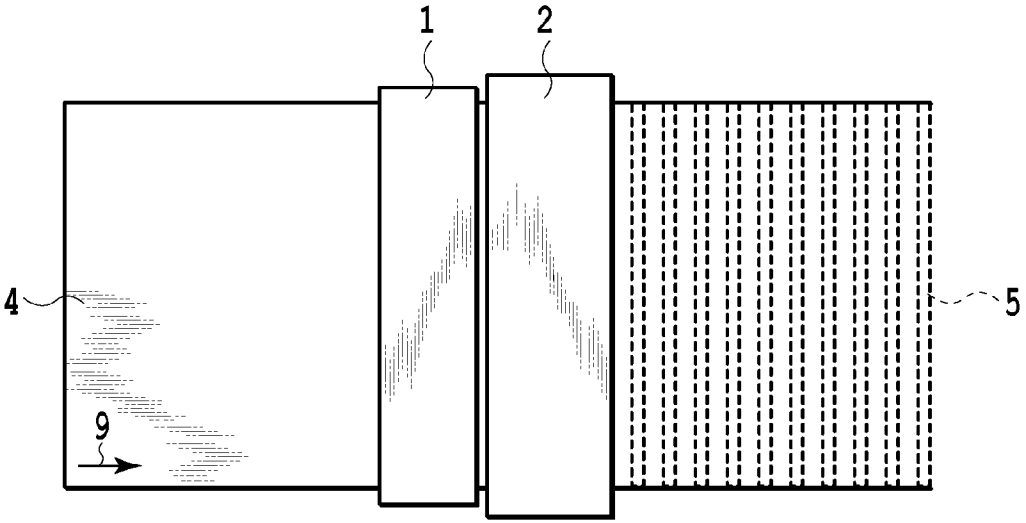
FIG. 11B is a plan view of the periphery of the print head and the blowout mechanism in the ink jet printing apparatus according to the ninth embodiment of the present invention.

FIG. 11A denotes a perspective view of the periphery of the print head 1 and the blowout mechanism 2 in the ink jet printing apparatus according to the ninth embodiment. FIG. 11B denotes a plan view of the periphery of the print head 1 and the blowout mechanism 2 in the ink jet printing apparatus according to the ninth embodiment.

As described above, the length of the electrode 5 along the direction in which the ejection port array is arranged is equal to or smaller than the length of the print medium along the direction in which the ejection port array is arranged so that, when the print medium is placed on the platen 36, the electrode 5 is covered with the print medium 4. Therefore, no portion of the electrode 5 protrudes out from the print medium 4 in the direction in which the ejection port array is arranged. Thus, the ink mist 8 can be restrained from adhering to and accumulating on the electrode 5 outside the print medium 4 in the direction in which the ejection port array is arranged. This enables the accumulated ink mist 8 to be restrained from adhering to the print medium, allowing possible degradation of the quality of the print image to be inhibited which is caused by the adhesion of the accumulated ink mist 8.

Tenth Embodiment

Now, an ink jet printing apparatus according to a tenth embodiment will be described. Components of the tenth embodiment similar to the corresponding components of the first to ninth embodiments are denoted by the same reference numerals in the figures and will not be described. Only differences from the first to ninth embodiments will be described.

In the first to ninth embodiments, the gas is blown out through the blowout port 3 in the blowout mechanism 2 toward the print medium in a direction substantially orthogonal to the surface of the print medium. In contrast, in the tenth embodiment, the gas is blown out through the blowout port 3 in the blowout mechanism 2 inclined toward the downstream side in the conveying direction of the print medium.

Figure 12:
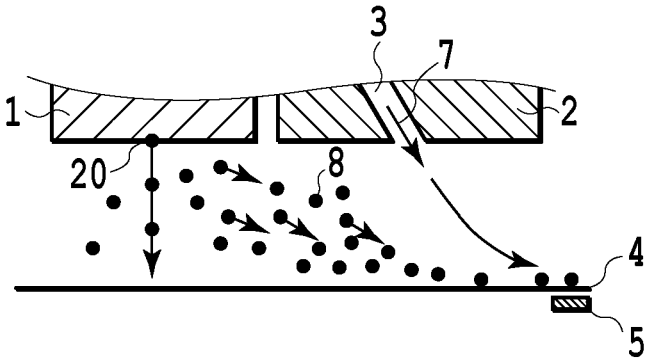
FIG. 12 is a cross-sectional view of the periphery of the ejection ports in the print head and the periphery of the blowout port in the blowout mechanism in an ink jet printing apparatus according to a tenth embodiment of the present invention.

FIG. 12 denotes a cross-sectional view of the periphery of the ejection ports 20 in the print head 1 and the periphery of the blowout port 3 in the blowout mechanism 2 in the ink jet printing apparatus according to the tenth embodiment.

Conveyance of the print medium 4 results in air currents flowing along the conveying direction in the area between the print medium 4 and both the print head 1 and the blowout mechanism 2. In the present embodiment, the gas is blown out through the blowout port 3 inclined toward the downstream side in the conveying direction of the print medium 4. Thus, the gas blown out through the blowout port 3 is entrained in the air currents flowing through the area between the print medium 4 and both the print head 1 and the blowout mechanism 2. Since the gas blown out through the blowout port 3 is entrained in the air currents flowing through the area between the print medium 4 and both the print head 1 and the blowout mechanism 2, the gas can be carried to the print medium 4 even when the blowout speed of the gas is low at the time of the blowout.

When blown out through the blowout port 3 in the blowout mechanism 2 in the direction orthogonal to the print medium 4 as in the first to ninth embodiments, the gas is blown out toward the print medium 4 against the air currents flowing along the conveying direction of the print medium 4. In this case, the gas is blown out against the air currents flowing along the conveying direction of the print medium 4. Thus, strong resistance is offered to the blowout of the gas, and a relatively high blowout speed may be needed to carry the gas to the print medium 4. In contrast, in the present embodiment, the gas is blown out through the blowout port 3 inclined toward the downstream side in the conveying direction of the print medium 4, with the gas being pushed by the air current. Consequently, the gas is blown out toward the print medium 4 with only weak resistance to the blowout. This allows the ink mist 8 present between the print medium 4 and both the print head 1 and the blowout mechanism 2 to be carried to the surface of the print medium 4 and attracted to the print medium 4 at a low gas blowout speed. Therefore, the ink mist 8 can be more efficiently collected.

Eleventh Embodiment

Now, an ink jet printing apparatus according to an eleventh embodiment will be described. Components of the eleventh embodiment similar to the corresponding components of the first to tenth embodiments are denoted by the same reference numerals in the figures and will not be described. Only differences from the first to tenth embodiments will be described.

As described above, the ink mist 8 is known to often have negative charge. Thus, in the first to tenth embodiments, the electrode 5 has positive polarity in order to attract the ink mist 8 with negative polarity.

However, the ink mist 8 may have positive polarity depending on the type of the ink. Thus, the eleventh embodiment is configured such that the electrode 5 has negative polarity to enable the ink mist 8 with positive polarity to be attracted. When such ink which generates the ink mist 8 with positive polarity is used for printing, the electrode 5 may be configured to have negative polarity.

Twelfth Embodiment

Now, an ink jet printing apparatus according to a twelfth embodiment will be described. Components of the twelfth embodiment similar to the corresponding components of the first to eleventh embodiments are denoted by the same reference numerals in the figures and will not be described. Only differences from the first to eleventh embodiments will be described.

In the first to tenth embodiments, the configuration has been described in which the electrode 5 has positive polarity because the ink mist 8 has negative polarity. Furthermore, in the eleventh embodiment, the configuration has been described in which the electrode 5 has negative polarity because the ink mist 8 has positive polarity.

However, a mixture of the ink mist 8 with positive polarity and the ink mist 8 with negative polarity may be present in the area between the print head 1 and both the blowout mechanism 2 and the print medium, depending on the type of the ink. Furthermore, the charge of the ink mist 8 used for printing may be unknown. When the mixture of the ink mist 8 with positive polarity and the ink mist 8 with negative polarity may be present or the charge of the ink mist 8 is unknown, the ink mist 8 with either charge can be desirably attracted. Thus, in the twelfth embodiment, electrodes 5*a* with positive polarity and electrodes 5*b* with negative polarity are disposed. In the present embodiment, the electrodes 5*a* with positive polarity and the electrodes 5*b* with negative polarity are alternately disposed along the conveying direction of the print medium 4.

Figure 13A:
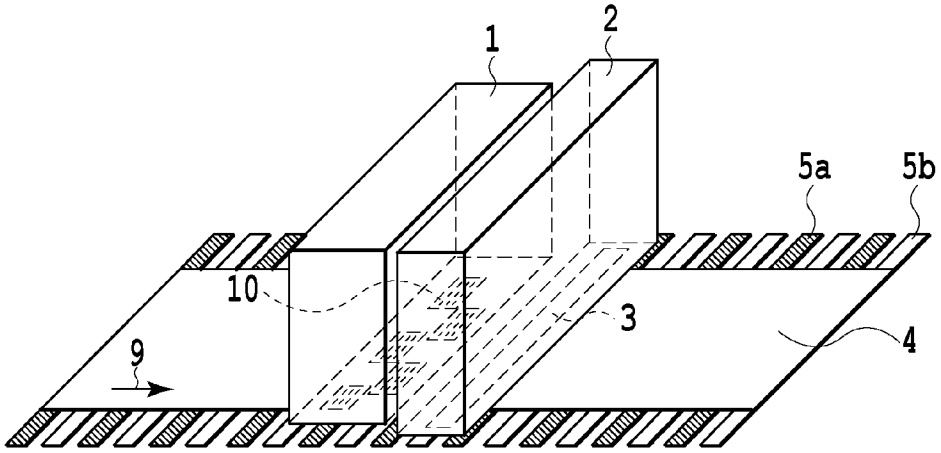
FIG. 13A is a perspective view of the periphery of the print head and the blowout mechanism in an ink jet printing apparatus according to a twelfth embodiment of the present invention.
Figure 13B:
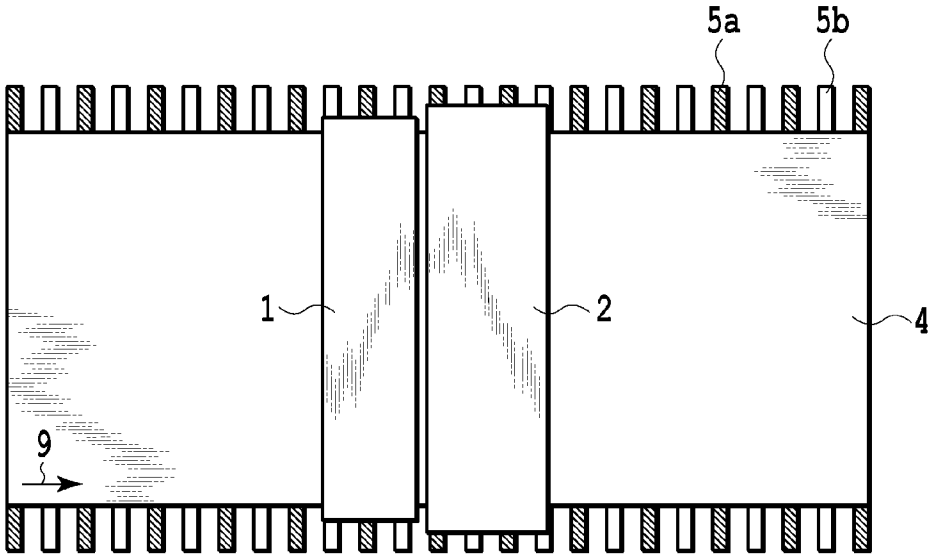
FIG. 13B is a plan view of the periphery of the print head and the blowout mechanism in the ink jet printing apparatus according to the twelfth embodiment of the present invention.

FIG. 13A denotes a perspective view of the ink jet printing apparatus according to the twelfth embodiment. FIG. 13B denotes a plan view of the ink jet printing apparatus according to the twelfth embodiment.

Thus, in the present embodiment, both the electrodes 5*a* with positive polarity and the electrodes 5*b* with negative polarity are disposed, allowing the ink mist 8 to be attracted to the print medium 4 for collection regardless of whether the ink mist 8 has positive or negative polarity. Therefore, the ink mist 8 can be more reliably collected.

In the specification, the term "printing" is used not only for formation of meaningful information such as characters and graphics but is used regardless of whether the printing result is meaningful or meaningless. Furthermore, the term "printing" broadly represents formation of an image, a pattern, or the like on a print medium or processing of the print medium, regardless of whether the image, pattern, or print medium is manifested so as to be visually perceived by human beings.

Furthermore, the "printing apparatus" includes apparatuses with a print function such as a printer, a multifunction printer, a copier, and a facsimile machine, and a manufacturing apparatus that manufactures articles using an ink jet function.

Additionally, the term "print medium" not only represents paper used for general printing apparatuses but also broadly represents media that can receive ink, such as a cloth, a plastic film, a metal plate, glass, ceramics, wood, and leather.

Moreover, the term "ink (also referred to as a "liquid") should be broadly interpreted as is the case with the definition of the above-described "printing". The term "ink" represents a liquid used to form an image, a pattern, or the like or to process a print medium or to treat ink (for example, solidification or insolubilization of a coloring material in ink applied to the print medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-116013, filed Jun. 4, 2014 which is hereby incorporated by reference wherein in its entirety.

What is claimed is:

1. A liquid ejection apparatus comprising:

an ejection port array in which ejection ports for ejecting a liquid toward a print medium are arranged;

a blowout mechanism configured to blow out a gas through a blowout port toward the print medium; and an electrode disposed on a platen that supports the print medium and configured to attract mist to the print medium when the electrode is supplied with power, wherein a length of the blowout port is longer than a length of the ejection port array and is shorter than a length of electrode in an ejection port array direction in which the ejection ports are arranged.

2. The liquid ejection apparatus according to claim 1, wherein the liquid ejection head moves relative to the print medium, and the blowout port is disposed rearward of the liquid ejection head in a direction of the relative movement.

3. The liquid ejection apparatus according to claim 1, wherein a plurality of the electrodes is disposed along the direction of movement of the liquid ejection head relative to the print medium.

4. The liquid ejection apparatus according to claim 1, wherein a support member configured to be able to support a liquid ejection head that ejects a liquid toward a print medium through ejection ports, and the support member moves to enable the liquid ejection head to move.

5. The liquid ejection apparatus according to claim 4, wherein two of the blowout port are disposed, and the liquid ejection head is disposed between the two blowout ports along the direction of movement of the liquid ejection head.

6. The liquid ejection apparatus according to claim 1, wherein the ejection port array extends all over the print medium in an arrangement direction in which the ejection port array is arranged, and the print medium is enabled to be conveyed along a conveying direction.

7. The liquid ejection apparatus according to claim 6, wherein the electrodes are disposed on the platen at positions corresponding to the liquid ejection head and at downstream positions with respect to the positions corresponding to the liquid ejection head in the conveying direction.

8. The liquid ejection apparatus according to claim 6, wherein the electrodes are disposed on the platen at downstream positions with respect to positions corresponding to the ejection ports in the conveying direction.

9. The liquid ejection apparatus according to claim 6, wherein the electrodes are disposed on the platen at positions corresponding to the blowout port and at downstream positions with respect to the positions corresponding to the blowout port in the conveying direction.

10. The liquid ejection apparatus according to claim 6, wherein the electrodes are disposed on the platen at downstream positions with respect to an area corresponding to a portion of the blowout mechanism opposite to the print medium, in the conveying direction.

11. The liquid ejection apparatus according to claim 6, wherein a plurality of the liquid ejection heads is supported, and a plurality of the blowout mechanisms is disposed in association with the respective plurality of liquid ejection heads, and the electrodes are disposed on the platen at positions corresponding to respective combinations of the liquid ejection head and the blowout mechanism.

12. The liquid ejection apparatus according to claim 6, wherein a length of each of the electrodes along the arrangement direction is equal to or smaller than a length of the liquid ejection head along the arrangement direction, and the electrode is disposed inside an area corresponding to the liquid ejection head in the platen.

13. The liquid ejection apparatus according to claim 6, wherein a length of each of the electrodes along the arrangement direction is equal to or smaller than a length of the liquid ejection head along the arrangement direction, and the electrode is covered with the print medium when the print medium is placed on the platen.

14. The liquid ejection apparatus according to claim 6, wherein the blowout port is formed to incline toward a downstream side in the conveying direction relative to a surface of the print medium.

15. The liquid ejection apparatus according to claim 1, wherein the electrodes with positive polarity and the electrodes with negative polarity are disposed on the platen.

16. The liquid ejection apparatus according to claim 1, wherein a voltage applied to the electrodes is equal to or more than 4 V.

17. A liquid ejection apparatus comprising:

an ejection port array in which ejection ports for ejecting a liquid toward a print medium are arranged;

a platen formed at position opposite to the ejection port and configured to support print medium;

a blowout port through which gas is blown out toward the print medium; and an electrode disposed on the platen and configured to attract mist, that is generated in association with ejection of main droplet through the ejection port, to print medium by supplying with power, wherein a length of the blowout port is longer than a length of the ejection port array and is shorter than a length of electrode in an ejection port array direction in which the ejection ports are arranged.

* * * * *